US005971139A

United States Patent [19]

Bradley

[11] Patent Number: 5,971,139

[45] **Date of Patent: *Oct. 26, 1999**

[54] FOOD AND BEVERAGE TRAY

[76] Inventor: Vincent H. Bradley, 11715 Pine Forest, Dallas, Tex. 75230

[ * ] Notice: This patent issued on a continued prosecution application filed under 37 CFR 1.53(d), and is subject to the twenty year patent term provisions of 35 U.S.C. 154(a)(2).

[21] Appl. No.: 08/839,721

[22] Filed: Apr. 15, 1997

[51] Int. Cl.[6] ..... A45C 11/20

[52] U.S. Cl. ..... 206/217; 206/549; 206/564

[58] Field of Search ..... 206/561, 564, 206/216, 217, 541, 549

[56] References Cited

U.S. PATENT DOCUMENTS

| | | | |
|---|---|---|---|
| D. 199,991 | 1/1965 | McManamey . | |
| D. 256,201 | 8/1980 | Ventura . | |
| D. 291,957 | 9/1987 | Stevens . | |
| D. 297,799 | 9/1988 | Hammer . | |
| D. 305,192 | 12/1989 | Van Erkel . | |
| D. 317,102 | 5/1991 | Clark et al. . | |
| D. 326,588 | 6/1992 | Meisel . | |
| D. 331,860 | 12/1992 | Stanfield . | |
| D. 338,374 | 8/1993 | Jacobson . | |
| D. 351,085 | 10/1994 | Schmidt . | |
| D. 352,205 | 11/1994 | Swetharanyam . | |
| D. 353,742 | 12/1994 | Lewis et al. . | |
| D. 354,201 | 1/1995 | Van De Graaf, Jr. . | |
| D. 356,471 | 3/1995 | Corsi . | |
| 3,498,470 | 3/1970 | Thomas . | |
| 3,504,832 | 4/1970 | Corvetti . | |
| 4,732,274 | 3/1988 | Bouton | 206/561 |
| 4,744,597 | 5/1988 | Bauman et al. . | |
| 4,989,742 | 2/1991 | Powell . | |
| 5,259,528 | 11/1993 | Pace et al. | 206/561 X |
| 5,335,787 | 8/1994 | Finchum . | |
| 5,346,070 | 9/1994 | McSpadden | 206/561 |
| 5,421,459 | 6/1995 | Mazzotti | 206/564 X |

*Primary Examiner*—Jacob K. Ackun
*Attorney, Agent, or Firm*—John M. Harrison

[57] ABSTRACT

A plate section includes a planar inner section, surrounded by a raised lip. A cup holder for holding a beverage container is attached to the plate section by an intermediate section. A hand grip extends downward from the intermediate section. The hand grip is hollow and provides space for tableware and condiments. Also, the hand grip has a plurality of serrations to facilitate gripping the hand grip. A plurality of supports extend downward from the plate section to provide additional support to the plate section when the food and beverage tray is placed upon a supporting a surface. The supports are spaced apart so as to extend downward on opposite sides of a person's arm when the food and beverage tray is held. A supplemental beverage container holder, including a pair of supplemental cup holders, connected by a supplemental intermediate section, may be inserted into the rest of the food and beverage tray. A supplemental hand grip extends downward from the supplemental intermediate section. One of the supplemental cup holders can be placed into the cup holder, and the supplemental hand grip can be placed into the hand grip, to form a food and beverage tray capable of holding two beverage containers.

16 Claims, 2 Drawing Sheets

FOOD AND BEVERAGE TRAY

BACKGROUND OF THE INVENTION

1. Field of the Invention

This invention relates in general to food trays. In particular, the invention relates to trays for holding a food plate and a beverage container in one hand.

2. Description of Related Art

Many people attend parties and other functions at which food and beverages are served. However, holding a tray of food in one hand and a beverage container in the other hand does not leave a hand free for other activities, such as shaking hands, opening doors, or selecting food items.

Therefore, many food trays have been designed to hold both a food plate and a beverage container. Many of these designs allow a person to hold a food tray in one hand, leaving the other hand free for other activities.

However, many of these prior art designs are difficult to hold without spilling the food or the beverage. Also, many of the designs cannot be nested into one another for storage. Thus, an improved design was desired.

SUMMARY OF THE INVENTION

The general object of the food and beverage tray of the invention is to easily hold a food plate and a beverage container in one hand. It is also desired that the trays be nested when not in use. In general, this object is accomplished by a food tray having a plate section for holding a food plate, attached by an intermediate section to a cup holder for holding a beverage container. The plate section has a planar inner section, surrounded by a raised lip to help keep the plate on the plate section. The raised lip is tapered downward, so that multiple food and beverage trays can be nested when not in use.

A hollow hand grip extends downward from the intermediate section, so that the food and beverage tray can be held in one hand. The hand grip is open at the top and closed at the bottom to provide space for holding tableware or condiments. The hand grip may also be serrated to provide a better grip.

The food and beverage tray of the invention may also include a supplemental beverage container holder. The supplemental beverage container holder includes a pair of supplemental cup holders, connected by a supplemental intermediate section. A supplemental hand grip extends downward from the supplemental intermediate section. The supplemental beverage container holder can be nested into the rest of the food and beverage tray to provide a second cup holder, so that the food and beverage tray can hold a plate and two beverage containers.

DESCRIPTION OF THE PREFERRED EMBODIMENT

Figure 1:
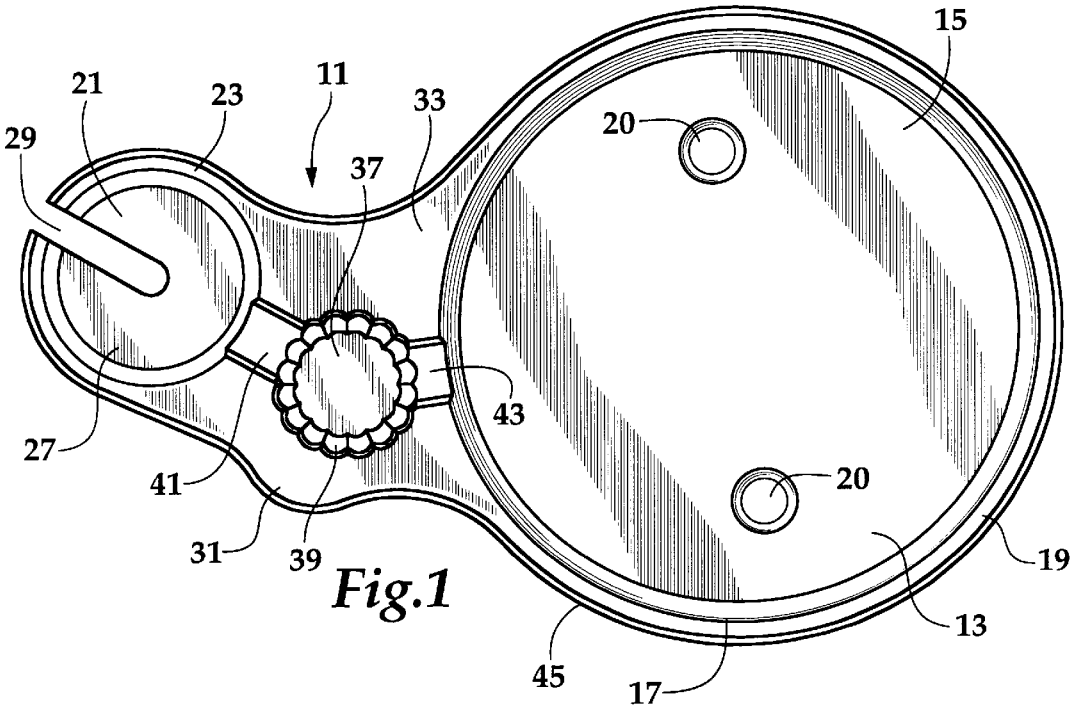
FIG. 1 is a top plan view of the food and beverage tray of the invention.
Figure 2:
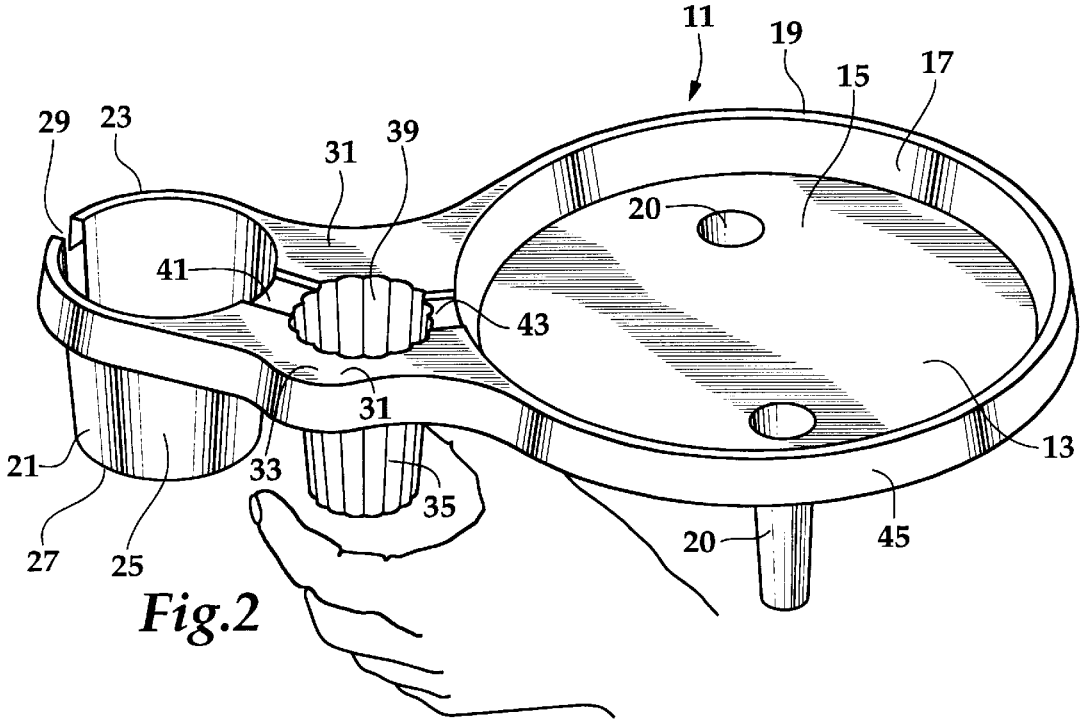
FIG. 2 is a perspective view of the food and beverage tray of the invention.

As shown in the drawings, the preferred embodiment of the food and beverage tray 11 of the invention includes a plate section 13. The plate section 13 has a circular, planar inner section 15, having a diameter of about ten inches (25.4 centimeters). A raised lip 17 runs around the circumference of the inner section 15 of the plate section 13, to help hold a plate on the plate section 13. The upper surface 19 of the raised lip 17 is planar and parallel to the planar inner section 15. The raised lip 17 is tapered downward to the inner section 15, so that multiple food and beverage trays 11 can be nested when not in use. Holes may be located in the inner section 13, for drainage of liquids from the plate section 13.

The plate section 13 also includes a pair of supports 20, extending downward from the inner section 15 of the plate section 13. The two support section 20 are frusto-conical and hollow, having an open top and a closed bottom. Holes may be located in the bottoms of the supports 20 to allow drainage of liquids from the supports 20. The supports 20 provide additional support to the plate section 13 when the food and beverage tray 11 is placed upon a supporting surface, since the bottoms of the supports 20 are coplanar with the bottom 27 of the cup holder 21 and with the bottom 37 of the hand grip 35.

Also, the supports 20 are spaced apart about four inches (about ten centimeters). The supports 20 thus extend downward on opposite sides of a person's arm when the food and beverage tray is held.

The food and beverage tray 11 of the invention also includes a cup holder 21 for holding a beverage container. The cup holder 21 has a planar upper surface 23, and a frusto-conical side 25, tapering downward to a planar bottom 27. The upper surface 23 of the cup holder 21 is coplanar with the upper surface 19 of the lip 17 of the plate section 13. The cup holder 21 should have a diameter sized to hold a standard beverage container, but several different diameters may be acceptable. A three and a half inch (8.9 centimeters) diameter would be acceptable in most cases.

The cup holder 21 may also have a slot 29 on one side and across the bottom 27. This slot 29 allows the cup holder 21 to hold a stemmed beverage container, such as a wine glass. If the cup holder 21 does not have such a slot 29, the cup holder 21 may have holes to allow liquids to drain from the cup holder 21.

The plate section 13 and the cup holder 21 are connected together by an intermediate section 31. The intermediate section 31 has a planar upper surface 33 that is coplanar with the upper surface 19 of the lip 17 and with the upper surface 23 of the cup holder 21.

A hollow, tapered hand grip 35 extends downward from the intermediate section 31, and has an open upper end and a bottom 37, forming a closed lower end. The inner portion of the hand grip 35 can be used to store tableware, condiments, or other useful items. The hand grip 35 should be sized to be easily grasped with a hand. The hand grip 35 may also have a plurality of serrations 39 around the grip 35, to facilitate grasping the grip 35. Holes may be located in the bottom 37 of the hand grip 35 to allow drainage of liquids from the grip 35.

The food and beverage tray 11 of the invention also has several additional features that add to the strength of the tray 11. The upper surface 33 of the intermediate section 31 may have an indentation 41 extending from the cup holder 21 to the hand grip 35. A second indentation 43 may extend from the plate section 13 to the hand grip 35. These indentations 41 and 43 in the upper surface 33 of the intermediate section 31 add strength to the food and beverage tray 11, so that more food and beverage can be held safely.

Another feature that adds strength to the food and beverage tray 11 is an apron 45 that extends around the perimeter of the entire food and beverage tray 11, including the cup holder 21, the intermediate section 31, and the plate section 13. The apron 45 extends downward about an inch (2.54 centimeters), and tapers outward. This apron 45 resists torsional forces on the food and beverage tray 11, so that more food and beverage can be carried safely.

Figure 3:
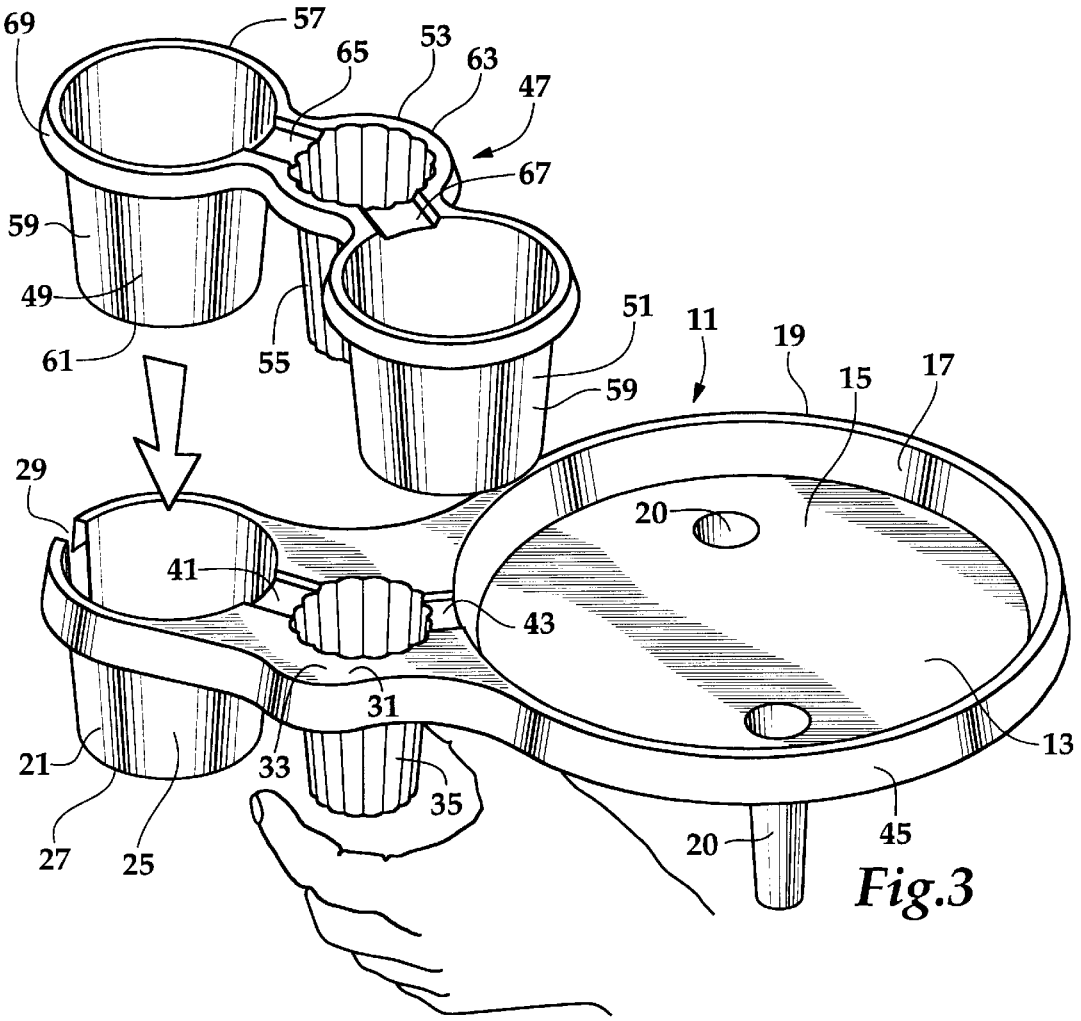
FIG. 3 is a perspective view of the food and beverage tray of the invention, with a supplemental beverage container holder being inserted into the rest of the food and beverage tray.
Figure 4:
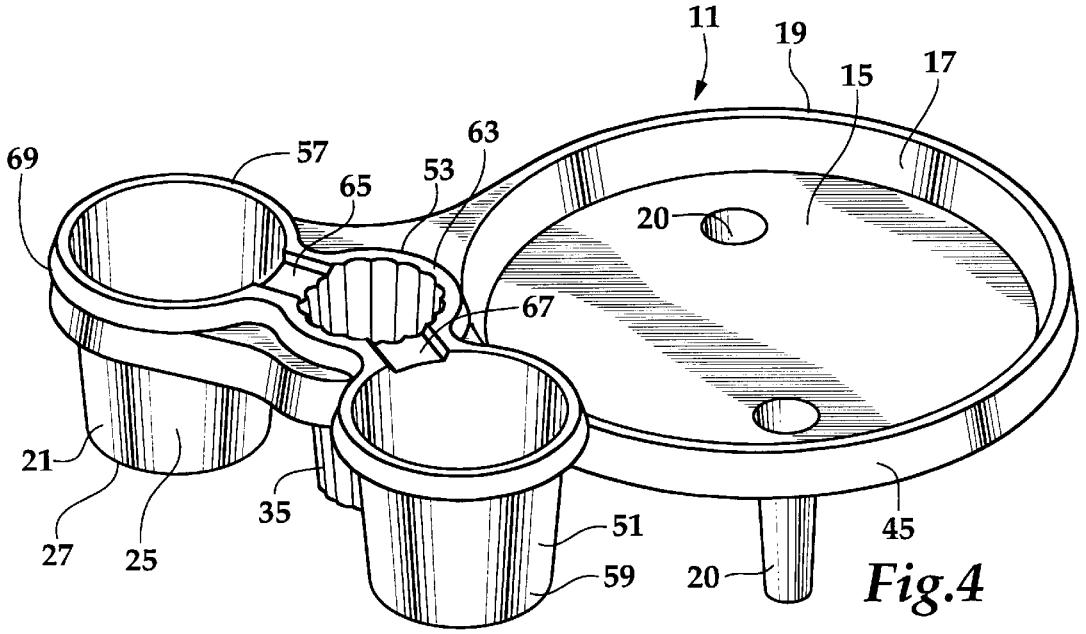
FIG. 4 is a perspective view of the food and beverage tray of the invention, including the supplemental beverage container holder.

As shown in FIGS. 3 and 4, the food and beverage tray 11 of the invention may also include a supplemental beverage container holder 47. The supplemental beverage container holder 47 includes a pair of supplemental cup holders 49 and 51, connected by a supplemental intermediate section 53. A supplemental hand grip 55 extends downward from the supplemental intermediate section 53. One of the supplemental cup holders 49 can be placed into the cup holder 21, and the supplemental hand grip 55 can be placed into the hand grip 35, to form a food and beverage tray 11 capable of holding two beverage containers.

Each of the supplemental cup holders 49 and 51 has a planar upper surface 57, and a frusto-conical side 59, tapering downward to a planar bottom 61. The upper surfaces 57 of the cup holders 49 and 51 are coplanar.

The supplemental intermediate section 53 also has a planar upper surface 63 that is coplanar with the upper surfaces 57 of the cup holders 49 and 51. The upper surface 63 of the supplemental intermediate section 53 may have an indentation 65 extending from one of the supplemental cup holders 49 to the supplemental hand grip 55, and a second indentation 67 may extend from the other cup holder 51 to the supplemental hand grip 55.

Another feature that adds strength to the supplemental beverage container holder 47 is an apron 69 that extends around the perimeter of the entire supplemental beverage container holder 47, including the supplemental cup holders 49 and 51 and the supplemental intermediate section 53. The apron 69 extends downward about an inch (2.54 centimeters), and tapers outward. This apron 69 resists torsional forces on the supplemental beverage container holder 47, so that more food and beverage can be carried safely.

As shown in FIGS. 3 and 4, one of the supplemental cup holders 49 can be placed into the cup holder 21, and the supplemental hand grip 55 can be placed into the hand grip 35. This forms a food and beverage tray 11 that can hold a food plate and two beverage containers, rather than just one.

The food and beverage tray 11 of the invention is very easy to use. The hand grip 35 is grasped in the hand, with the two supports 20 on either side of the arm. Then, a food plate can be placed on the plate section 13, and a beverage container can be placed in the cup holder 21. Other items, such as tableware and condiments, can be placed in the hand grip 35. If two beverage containers are to be carried, the supplemental beverage container holder 47 can be added to the rest of the food and beverage tray 11. When not in use, the food and beverage trays 11 of the invention can be nested within one another.

The food and beverage tray 11 of the invention has several advantages over the prior art. The tray 11 is light-weight, and easy to hold and to handle. However, the tray 11 is also strong, and capable of holding a full plate of food and one or two beverage containers, without spilling. When not in use, the nesting of the trays 11 saves space in the storage area.

The invention has been described in only one embodiment. It should be apparent to those skilled in the art that the invention is not so limited, but is susceptible to various changes and modifications without departing from the spirit of the invention.

I claim:

1. A food and beverage tray, comprising:

a circular plate section having a planar inner section and a raised lip surrounding said planar inner section for supporting a circular plate:

a circular cup holder for holding a circular beverage container;

an intermediate section connecting the plate section to the cup holder;

a hand grip extending downward from the intermediate section; and a pair of supports extending downward from the plate section for providing additional support to the plate section when the food and beverage tray is placed upon a supporting surface, and wherein the supports are spaced apart so as to extend downward on opposite sides of a person's arm when the food and beverage tray is held.

2. A food and beverage tray, as recited in claim 1, wherein the hand grip is hollow and has an open upper end and a closed lower end, for providing space for containing tableware and condiments.

3. A food and beverage tray, as recited in claim 1, wherein the hand grip is hollow and has an open upper end and a closed lower end, for providing space for containing tableware and condiments, and wherein the hand grip is tapered downward, so that the food and beverage tray can be nested with other food and beverage tray of the same design.

4. A food and beverage tray, as recited in claim 1, wherein the plate section includes a planar inner section, surrounded by a raised lip, and wherein the raised lip is tapered downward, so that the food and beverage tray can be nested with other food and beverage tray of the same design.

5. A food and beverage tray, as recited in claim 1, wherein the cup holder is tapered downward, so that the food and beverage tray can be nested with other food and beverage tray of the same design.

6. A food and beverage tray, as recited in claim 1, wherein the hand grip has a plurality of serrations to facilitate gripping the hand grip.

7. A food and beverage tray, as recited in claim 1, further comprising a plurality of supports, extending downward from the plate section for providing additional support to the plate section when the food and beverage tray is placed upon a supporting surface.

8. A food and beverage tray, as recited in claim 1, wherein the cup holder has a bottom and the hand grip has a bottom that is coplanar with the bottom of the cup holder.

9. A food and beverage tray, as recited in claim 8, wherein the diameter of the hand grip is significantly smaller than the diameter of the cup holder.

10. A food and beverage tray, comprising:

a planar plate section bounded by a raised lip for supporting a plate;

a cup holder for holding a beverage container wherein the cup holder has a bottom;

an intermediate section, connecting the plate section to the cup holder;

a hand grip extending downwardly from the intermediate section, wherein the hand grip has a bottom that is coplanar with the bottom of the cup holder; and a pair of supports extending downward from the plate section for providing additional support to the plate section when the food and beverage tray is placed upon a supporting surface, and wherein the supports are spaced apart so as to extend downward on opposite sides of a person's arm when the food and beverage tray is held.

11. A food and beverage tray, as recited in claim 10, wherein the hand grip is hollow and has an open upper end and a closed lower end, for providing space for containing tableware and condiments.

12. A food and beverage tray, as recited in claim 11, wherein the raised lip, the cup holder, and the hand grip are all tapered downward, so that the food and beverage tray can be nested with other food and beverage tray of the same design.

13. A food and beverage tray, as recited in claim 12, further comprising a plurality of supports, extending downward from the plate section for providing additional support to the plate section when the food and beverage tray is placed upon a supporting surface.

14. A food and beverage tray, comprising:

a plate section for supporting a plate;

a cup holder for holding a beverage container;

an intermediate section, connecting the plate section to the cup holder;

a hand grip extending downward from the intermediate section; and a supplemental beverage container holder, including a pair of supplemental cup holders, connected by a supplemental intermediate section, and a supplemental hand grip, extending downward from the supplemental intermediate section, wherein one of the supplemental cup holders can be placed into the cup holder, and the supplemental hand grip can be placed into the hand grip, to form a food and beverage tray capable of holding two beverage containers.

15. A food and beverage tray, as recited in claim 14, further comprising a plurality of supports, extending downward from the plate section for providing additional support to the plate section when the food and beverage tray is placed upon a supporting surface.

16. A food and beverage tray, as recited in claim 15, further comprising a pair of supports, extending downward from the plate section for providing additional support to the plate section when the food and beverage tray is placed upon a supporting surface, and wherein the supports are spaced apart so as to extend downward on opposite sides of a person's arm when the food and beverage tray is held.

* * * * *